US006979059B1

(12) United States Patent
Conlin

(10) Patent No.: US 6,979,059 B1
(45) Date of Patent: Dec. 27, 2005

(54) ROCKING CHAIR CONSTRUCTION

(75) Inventor: Patrick Curtis Conlin, Perham, MN (US)

(73) Assignee: HC Holdings, LLC, Wadena, MN (US)

( * ) Notice: Subject to any disclaimer, the term of this patent is extended or adjusted under 35 U.S.C. 154(b) by 0 days.

(21) Appl. No.: 10/942,215

(22) Filed: Sep. 16, 2004

(51) Int. Cl.[7] ..... A47C 7/00; A47C 1/024; A47C 3/026

(52) U.S. Cl. ..... 297/440.15; 297/440.14; 297/440.2; 297/300.1; 297/300.2; 297/313; 297/314; 297/325

(58) Field of Search ..... 297/440.1, 440.14, 297/440.15, 440.16, 440.2, 440.21, 440.22, 297/325, 326, 300.1, 313, 314, 302.3

(56) References Cited

U.S. PATENT DOCUMENTS

| | | | | | |
|---|---|---|---|---|---|
| 2,787,315 | A * | 4/1957 | Siebert | 297/313 X |
| 2,916,084 | A | 12/1959 | Bottemiller et al. | 155/95 |
| 3,907,363 | A * | 9/1975 | Baker et al. | 297/440.2 X |
| 4,068,888 | A | 1/1978 | Bottemiller | 297/317 |
| 4,371,142 | A | 2/1983 | Bottemiller et al. | 248/573 |
| 4,383,714 | A * | 5/1983 | Ishida | 297/325 |
| 4,411,468 | A | 10/1983 | Apissomian | 297/264 |
| 4,718,723 | A | 1/1988 | Bottemiller | 297/265 |
| 4,786,106 | A | 11/1988 | Bottemiller | 297/265 |
| 4,890,886 | A * | 1/1990 | Opsvik | 297/313 |
| 5,634,688 | A | 6/1997 | Ellis | 297/358 |
| 5,769,492 | A * | 6/1998 | Jensen | 297/314 |
| 5,904,397 | A * | 5/1999 | Fismen | 297/313 X |
| 6,019,422 | A * | 2/2000 | Taormino et al. | 297/313 X |
| 6,290,296 | B1 * | 9/2001 | Beggs | 297/300.1 X |
| 6,341,822 | B2 | 1/2002 | Apissomian | 297/440.11 |
| 6,345,428 | B2 | 2/2002 | Apissomian | 29/428 |
| 6,481,795 | B1 * | 11/2002 | Pettibon | 297/314 |
| 6,488,335 | B1 * | 12/2002 | Cioncada | 297/300.2 |
| 6,568,760 | B2 * | 5/2003 | Davis et al. | 297/440.14 |
| 6,685,268 | B2 * | 2/2004 | Meyer | 297/313 |
| 6,869,142 | B2 * | 3/2005 | Heidmann et al. | 297/300.1 |
| 2002/0043846 | A1 * | 4/2002 | Brauning | 297/314 |
| 2002/0060486 | A1 * | 5/2002 | Meyer | 297/300.1 |
| 2003/0001420 | A1 * | 1/2003 | Koepke et al. | 297/440.15 |

* cited by examiner

*Primary Examiner*—Rodney B. White
(74) *Attorney, Agent, or Firm*—Westman, Champlin & Kelly, P.A.

(57) ABSTRACT

A rocking chair has a flexible joint between a chair base and a chair component permitting rocking action. The flexible joint includes a housing with a plurality of internal surfaces. A plurality of compressible rods are disposed within the housing and a rigid member extends among the rods to engage the rods against the internal surfaces of the housing. The rigid member is attached to either the chair base or the chair component while the housing is then attached to either the chair base or the chair component whichever is not attached to the rigid member.

25 Claims, 2 Drawing Sheets

ROCKING CHAIR CONSTRUCTION

BACKGROUND OF THE INVENTION

The present invention relates to a rocking chair in which a chair component is movable in a rocking motion with respect to a chair base.

There are many types of rocking mechanisms that permit movement of a chair component with respect to a chair base. One such rocking mechanism that uses a pair of coil springs is the described in the Bottemiller et al. U.S. Pat. Nos. 2,916,084 and 4,786,106.

Other types of rocking mechanisms are also described in Bottemiller et al. U.S. Pat. No. 4,371,142 and the Apissomian U.S. Pat. No. 4,411,468.

SUMMARY OF THE INVENTION

The present invention includes a rocking chair which has a flexible joint between a chair base and a chair component permitting rocking action. The flexible joint includes a housing with a plurality of internal surfaces. A plurality of compressible rods are disposed within the housing and a rigid member extends among the rods to engage the rods against the internal surfaces of the housing. The rigid member is attached to either the chair base or the chair component while the housing is then attached to either the chair base or the chair component whichever is not attached to the rigid member.

DETAILED DESCRIPTION OF THE PREFERRED EMBODIMENTS

Figure 1:
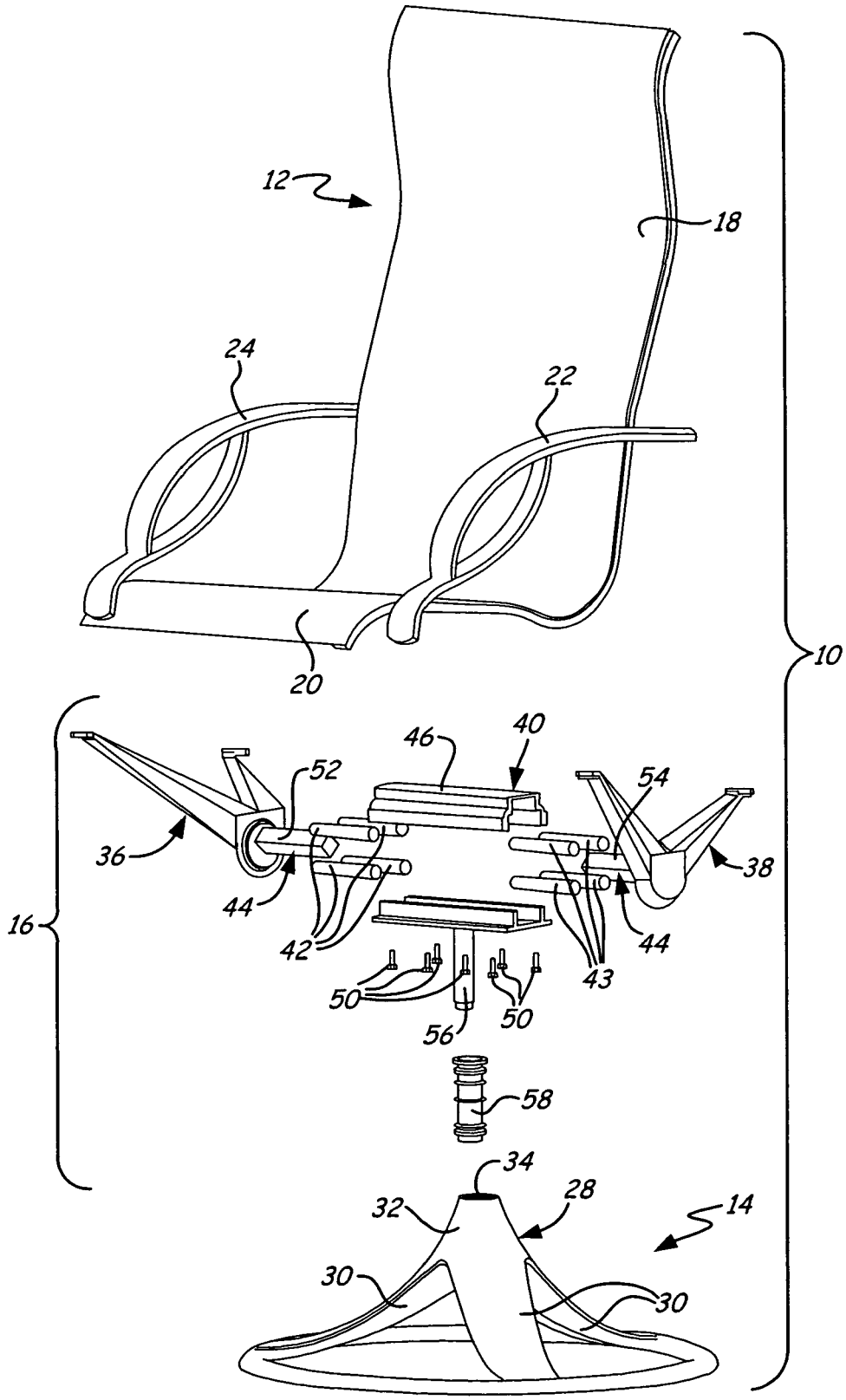
FIG. 1 is an exploded perspective view of the rocking chair of the present invention.

A rocking chair construction of the present invention is generally indicated at 10 in FIG. 1. The rocking chair 10 has a chair component 12, a base 14 and a rocking mechanism 16 that connects the chair component 12 and the base 14. The rocking mechanism 16 permits the chair component 12 to move in a rocking manner in relation to the base 14. Preferably, although not necessary, the chair component 12 also rotates 360° with respect to the base 14.

The chair component 12 includes a back portion 18 and a seat portion 20 and left and right arm sections 22 and 24 which extend between the seat portion 20 and the back portion 18. Although a specific chair component is described and illustrated, any type of a chair component that can be secured to the rocking mechanism 16 is within the scope of the present invention.

The base 14 as illustrated in FIG. 1 is a pedestal type base have a pedestal portion 28 attached to a ground engaging ring portion 26. The pedestal portion 28 is attached to the ring 26 through three finger sections 30 that engage the ring 26 at three substantially equally spaced apart points. The finger sections 30 converge at an apex 32 of the pedestal portion 28. The apex 32 includes an aperture 34 whose axis is disposed substantially vertically. Although a pedestal base is described and illustrated other bases which can be secured to the rocking mechanism that provide sufficient stability for a rocking motion are within the scope of the present invention.

The rocking mechanism 16 includes left and right support arms 36 and 38, a housing 40, a plurality of resiliently compressible rods 42, 43 and a separator bar 44.

Figure 2:
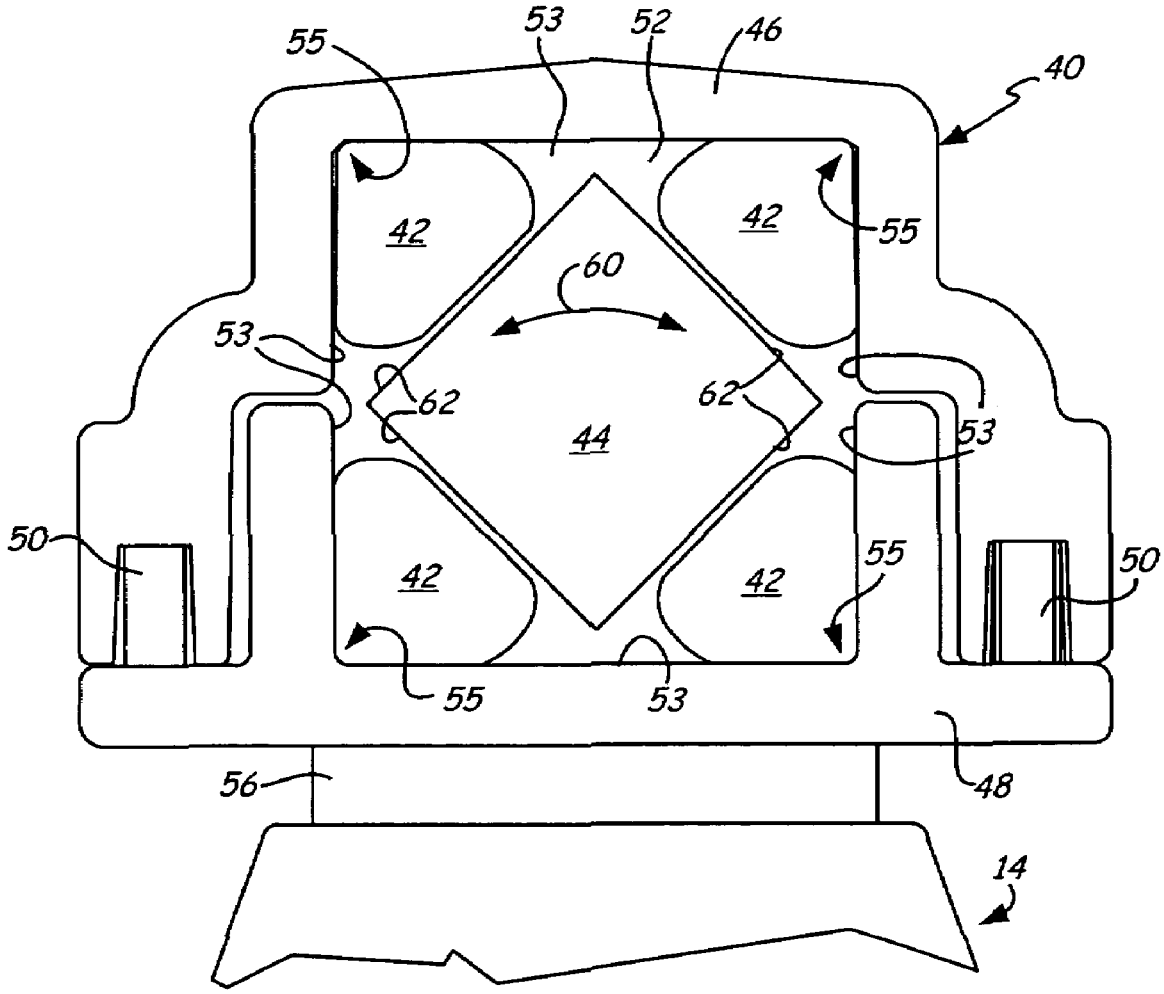
FIG. 2 is a sectional view of the rocking mechanism.

The housing 40 includes an upper half 46 and a lower half 48 which are secured to each other by a plurality of screws 50 to form a chamber 52 as best illustrated in FIG. 2. The chamber 52 has a plurality of internal surfaces 53. The resiliently compressible rods 42, 43 are disposed within the chamber 52 and separated from each other by the bar 44. The resiliently compressible rods 42 are disposed in a parallel relationship with each other. Similarly, the rods 43 are also disposed in substantial parallel relationship with each other. For each rod 42, there is an adjacent rod 43 positioned such that longitudinal axis of both rods are substantially coaxially disposed. It should be understood, that a rod of one length (running the length of the housing) can be substituted for each combination of rods 42 and 43. The rods 42 and 43 are retained in corners 55 by engaging adjacent surfaces 53 of the chamber 52. The separator bar 44 extends through the chamber 52 separating the rods 42, 43 and helping to retain the rods 42, 43 within the corners 55.

The separator bar 44 is fixedly attached at a left end 52 to the left support arm 36 and at a right end 54 to the right support arm 38. The left and right support arms 36 and 38 are fixedly attached to the chair component 12 by suitable screws or other fasteners or by welding or other known methods of attachment. The manner of attachment is not important to the present invention.

The lower half of the housing 48 is fixedly attached to a downwardly extending shaft 56. A sleeve 58 extends through the aperture 34 into the base 14 securing the shaft 56 to the base 14. The sleeve 58 receives the shaft 56 such that the shaft 56 rotates within the sleeve 58. It will be understood that the chair component is rotatable 360° relative to the base 14.

Although the housing is described and illustrated as being attached to the base 14 and the bar 44 being attached to the chair component 12, the attachments could be reversed. The housing could be attached to the chair component while the bar 44 is attached to the base.

The rods 42, 43 are preferably made from a polyurethane elastomer. An important characteristic of the rods 42, 43 are that the rods are resiliently compressible. The rods are preferred to be compressible. By resiliently compressible is meant that the material that the rods are made of has the ability to recover and return to its original shape or position after having been compressed.

As the chair component 12 is rocked back and forth, the separator bar 44 through its connection to left and right support arms 36 and 38 is moved along its longitudinal axis back and forth as indicated by arrow 60. Surfaces 62 of the separator bar 44 engage the resiliently compressible rods 42, 43. Since the rods 42, 43 are compressible, the rods 42 permit the bar 44 to turn along its longitudinal axis as indicated by arrow 60 thereby permitting a rocking motion to the chair component 12. The rods 42, 43 provide a resistance to the movement of the chair component which is desirable in a rocking mechanism. Since the rods 42, 43 are also resilient, that is, the rods are capable of returning to their original shape or position after having been compressed, the chair component 12 will return to its original position since the rods 42, 43 force the separator bar 44 to move back to its original position.

Preferably, the polyurethane rods have a durometer of approximately 60 Shore A hardness. The stiffness (resistance) of the rocking motion is changeable by durometer and rod diameter size or thickness. Theoretically, there is no lower limit to the durometer needed other than that the rocking motion will not be stiff enough if too low of a durometer is chosen. However, at higher durometers, the rods 42, 43 may start to take a permanent set and shape, and although providing a rocking motion, such rods will not provide as smooth of a rocking motion to the chair component 12. In the example of polyurethane, polyurethane will take a permanent set and shape at a durometer of approximately 80 Shore A hardness and higher. For materials other than polyurethane, the upper limit may be a different durometer value. It has been found that for polyurethane a suitable durometer is approximately 50 to 65 Shore A hardness.

While polyurethane has been given as a specific example, other materials may be used such as other elastomers. It is believed that other materials will work as well as polyurethane as long as the material is resiliently compressible. Synthetic and natural rubbers will also produce a rocking motion although not as desirable as the rocking motion produced by polyurethane.

Although the separator bar is illustrated in FIG. 2 as having a square cross section, other cross section configurations are includeable within the present invention. Other four sided polygon configurations such as rectangular are suitable. Other multiple sided polygon configurations such as a triangular cross section with three surfaces engaging the rods may be suitable if the rods encased within the housing are held in position.

Similarly, the cross sectional configuration of the rods does not have to be circular. Depending on the internal shape of the chamber of housing, the rods may have a different cross sectional configuration other than circular. The primary characteristic needed is that the rods 42, 43 engage a surface of the bar 44 when the bar is turned about its axis and to provide some resistive force during the rocking motion.

Although the present invention has been described with reference to preferred embodiments, workers skilled in the art will recognize that changes may be made in form and detail without departing from the spirit and scope of the invention.

What is claimed is:

1. A rocking chair comprising:

a chair base;

a chair component; and a flexible joint attaching the chair component with the chair base, the flexible joint comprising a housing with a plurality of internal surfaces, and a plurality of compressible rods disposed within the housing and substantially parallel to each other and a rigid member extending substantially parallel to and among the rods, the rigid member engaging the rods against the internal surfaces of the housing during back and forth rocking movement of the chair component, the rigid member being attached to either the chair base and the housing being attached to the chair component, or the rigid member being attached to the chair component and the housing being attached to the chair base.

2. The rocking chair of claim 1 wherein the rigid member has four surfaces, each of the surfaces being engaged by one of the rods.

3. The rocking chair of claim 1 wherein the rods are made of a polyurethane elastomer.

4. The rocking chair of claim 3 wherein the polyurethane elastomer has a durometer of less than approximately 80 Shore A hardness.

5. The rocking chair of claim 3 wherein the polyurethane has a durometer in the range of approximately 50 to 65 Shore A hardness.

6. The rocking chair of claim 1 wherein the housing is rotatably attached to the chair base.

7. The rocking chair of claim 1 wherein the rigid member extends through the housing and is fixedly attached to the chair component and the housing being attached to the chair base.

8. The rocking chair of claim 1 wherein the housing has four internal surfaces and wherein each of the rods are held within a corner formed by adjacent surfaces.

9. The rocking chair of claim 1 wherein the rods are resiliently compressible.

10. A rocking chair comprising:

a chair base;

a chair component;

a hollow chamber attached to either the chair base or the chair component;

a compressible material disposed within the hollow chamber;

a rigid shaft extending through the hollow chamber and through the compressible material and suspended from direct contact with the hollow chamber by the compressible material, the rigid shaft being attached to the chair base and the hollow chamber being attached to the chair component or the rigid shaft being attached to the chair component and the hollow chamber being attached to the chair base.

11. The rocking chair of claim 10 wherein the compressible material is resiliently compressible.

12. The rocking chair of claim 10 wherein the rigid member has four surfaces, each of the surfaces being engaged by the compressible material.

13. The rocking chair of claim 12 wherein the polyurethane has a durometer in the range of approximately 50 to 65 Shore A hardness.

14. The rocking chair of claim 10 wherein the compressible material is made of a polyurethane elastomer.

15. The rocking chair of claim 14 wherein the polyurethane elastomer has a durometer of less than approximately 80 Shore A hardness.

16. The rocking chair of claim 10 wherein the chamber is defined by a housing and the housing is rotatably attached to the chair base.

17. The rocking chair of claim 10 wherein the rigid member extends through the chamber and is fixedly attached to the chair component and the chamber is defined by housing that is attached to the chair base.

18. The rocking chair of claim 10 wherein the chamber is defined by four internal surfaces and wherein the compressible material comprises a plurality of rods and wherein each of the rods are held within a corner formed by adjacent surfaces.

19. A rocking chair comprising:

a chair base;

a chair component;

a housing;

a compressible material disposed within the housing;

a rigid member having four surfaces and extending through the compressible material and engaging the compressible material with each of the surfaces such that if the housing rotates with respect to the rigid material, at least a portion of the compressible material is compressed; and wherein the housing is attached to the chair base when the rigid member is attached to the chair component or to the chair component when the rigid member is attached to the chair base.

20. The rocking chair of claim 19 wherein the compressible material is made of a polyurethane elastomer.

21. The rocking chair of claim 20 wherein the polyurethane elastomer has a durometer of less than approximately 80 Shore A hardness.

22. The rocking chair of claim 20 wherein the polyurethane has a durometer in the range of approximately 50 to 65 Shore A hardness.

23. The rocking chair of claim 19 wherein the housing is rotatably attached to the chair base.

24. The rocking chair of claim 19 wherein the rigid member extends through the housing and is fixedly attached to the chair component and the housing being attached to the chair base.

25. The rocking chair of claim 19 wherein the compressible material is resiliently compressible.

* * * * *